US008123218B2

(12) United States Patent
Yasumoto

(10) Patent No.: US 8,123,218 B2
(45) Date of Patent: Feb. 28, 2012

(54) SHEET CONVEYANCE APPARATUS AND IMAGE FORMING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/641,165

(22) Filed: Dec. 17, 2009

(65) Prior Publication Data

US 2010/0102504 A1 Apr. 29, 2010

Related U.S. Application Data

(63) Continuation of application No. 12/245,125, filed on Oct. 3, 2008, now Pat. No. 7,658,379.

(30) Foreign Application Priority Data

Oct. 5, 2007 (JP) ..... 2007-262477

(51) Int. Cl.
*B65H 9/16* (2006.01)

(52) U.S. Cl. ..... 271/251; 271/249; 271/228; 271/250

(58) Field of Classification Search ..... 271/228, 271/248, 249, 250, 251, 273
See application file for complete search history.

(56) References Cited

U.S. PATENT DOCUMENTS

| | | | | |
|---|---|---|---|---|
| 4,426,073 | A * | 1/1984 | Mizuma | 271/251 |
| 4,558,373 | A * | 12/1985 | Plasencia et al. | 358/484 |
| 6,059,285 | A * | 5/2000 | Suga et al. | 271/228 |
| 6,135,446 | A * | 10/2000 | Thiemann et al. | 271/228 |
| 6,715,755 | B2 * | 4/2004 | Sussmeier | 271/251 |
| 6,817,609 | B2 * | 11/2004 | Halvonik et al. | 271/228 |
| 6,942,214 | B2 * | 9/2005 | Riccardi | 271/227 |
| 2003/0075861 | A1 * | 4/2003 | Sussmeier | 271/251 |

FOREIGN PATENT DOCUMENTS

JP 2003146489 A * 5/2003

* cited by examiner

*Primary Examiner* — Kaitlin Joerger
(74) *Attorney, Agent, or Firm* — Canon, U.S.A., Inc. IP Division

(57) ABSTRACT

A skew roller is disposed near an abutment reference member. A pre-skew roller is disposed on the upstream side of the skew roller at a position corresponding to a conveyance center line. When a sheet conveyed by a pre-registration conveyance roller reaches the skew roller, the pre-registration conveyance roller moves upward to release a nipping force applied on the sheet. At the same time, the pre-skew roller moves downward to start aligning the sheet.

6 Claims, 11 Drawing Sheets

SHEET CONVEYANCE APPARATUS AND IMAGE FORMING APPARATUS

CROSS-REFERENCE TO RELATED APPLICATIONS

This application is a Continuation of U.S. patent application Ser. No. 12/245,125, filed on Oct. 3, 2008, which claims priority to Japanese Patent Application No. 2007-262477, filed on Oct. 5, 2007, the contents of which are hereby incorporated by reference.

BACKGROUND OF THE INVENTION

1. Field of the Invention

The present invention relates to a sheet conveyance apparatus capable of correcting skew of a sheet while conveying the sheet.

2. Description of the Related Art

An image forming apparatus includes a sheet conveyance apparatus configured to correct skew of a sheet by conveying a plurality of sheets speedily and successively along a reference surface while maintaining a short interval between a trailing edge of a preceding sheet and a leading edge of a following sheet.

As discussed in Japanese Patent Application Laid-Open No. 11-189355, an electrophotographic image forming apparatus includes a sheet conveyance apparatus disposed on the upstream side of a toner image transfer unit. A reference member, positioned near a sheet conveyance path, has a reference surface parallel to a conveyance direction of sheets.

Two or more skew rollers, located close to the reference surface, obliquely convey a sheet toward the reference surface. When the sheet collides with the reference surface, the sheet rotates to correct its orientation and starts moving straight along the reference surface. A positioning roller, located on the downstream side of the reference surface, is movable in a direction perpendicular to the sheet conveyance direction. When the positioning roller conveys a skew-corrected sheet in a direction perpendicular to the sheet conveyance direction, the sheet reaches a predetermined set position.

As discussed in Japanese Patent Application Laid-Open No. 2003-146489, an electrophotographic image forming apparatus includes a sheet conveyance apparatus disposed near a conveyance path used for reverse surface printing. The sheet conveyance apparatus includes a first skew roller positioned close to a reference surface and a second skew roller disposed on the upstream side of the first skew roller and positioned far from the reference surface. A skew amount set for the second skew roller is comparable to that for the first skew roller. Therefore, when the first skew roller starts conveying a sheet, the sheet does not rotate around its centroid.

A sheet conveyance apparatus discussed in Japanese Patent Application Laid-Open No. 2005-104712 includes a first skew roller and a second skew roller positioned on the upstream side of the first skew roller. The first skew roller contacts a surface of a sheet at a position closer to a reference surface than the centerline of a sheet parallel to the sheet conveyance direction. The second skew roller contacts a surface of a sheet at a position far from the reference surface than the centerline.

Recent image forming apparatuses are required to perform image formation on various types of sheets which are different from commonly used plain papers and coated papers in grammage, coefficient of friction, size, and conveyance orientation. According to the above-described conventional sheet conveyance apparatus, when the upstream skew roller obliquely conveys a sheet toward a reference surface, the sheet cannot stably maintain its orientation until the sheet reaches the downstream skew roller.

Although more details will be described in comparative examples, while only the upstream skew roller nips a conveyed sheet, the sheet rotates around the upstream skew roller. For example, if the lower surface of a lightweight sheet has a large coefficient of friction and the sheet is short in the direction parallel to a reference surface, the sheet rotates with a large angle and the amount of skew becomes larger.

When the amount of skew is excessively large, the downstream skew roller positioned near the reference surface may not be able to accomplish skew correction before the sheet thoroughly passes the reference surface. In other words, if a skew roller rotates a sheet, the rotating sheet cannot smoothly move toward the reference surface as intended and rather makes it difficult to accomplish the skew correction.

Furthermore, it is desirable that skew rollers do not interfere with a sheet during the skew correction or do not buckle the sheet in the process of aligning the sheet along the reference surface. To this end, when skew rollers obliquely convey a sheet, the rollers allow the sheet to freely slide and rotate. In a state where a sheet is obliquely conveyed by a pair of (upstream and downstream) skew rollers, if two rollers have differences in conveyance resistance (friction) acting between a sheet and a guide surface, the sheet rotates unwontedly and the orientation of the conveyed sheet becomes unstable.

SUMMARY OF THE INVENTION

Exemplary embodiments of the present invention are directed to a sheet conveyance apparatus capable of stabilizing the orientation of a conveyed sheet to ensure skew correction. Components and a control method of the sheet conveyance apparatus are commonly applicable to various sheets.

According to an aspect of the present invention, a sheet conveyance apparatus includes a reference member disposed in a sheet conveyance direction so as to align a side of a sheet along the reference member, a first skew rotary member configured to obliquely convey the sheet toward the reference member, a second skew rotary member positioned on an upstream side of the first skew rotary member and farther from the reference member than the first skew rotary member, at a position corresponding to a central position of the sheet in a direction perpendicular to the sheet conveyance direction, and configured to obliquely convey the sheet toward the reference member, a contact/separation mechanism configured to bring the second skew rotary member into contact with the sheet or separate the second skew rotary member from the sheet, and a control unit configured to control the contact/separation mechanism to cause the second skew rotary member to contact the sheet at a timing when the sheet, which is separated from the second skew rotary member and is being conveyed in the sheet conveyance direction, reaches the first skew rotary member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
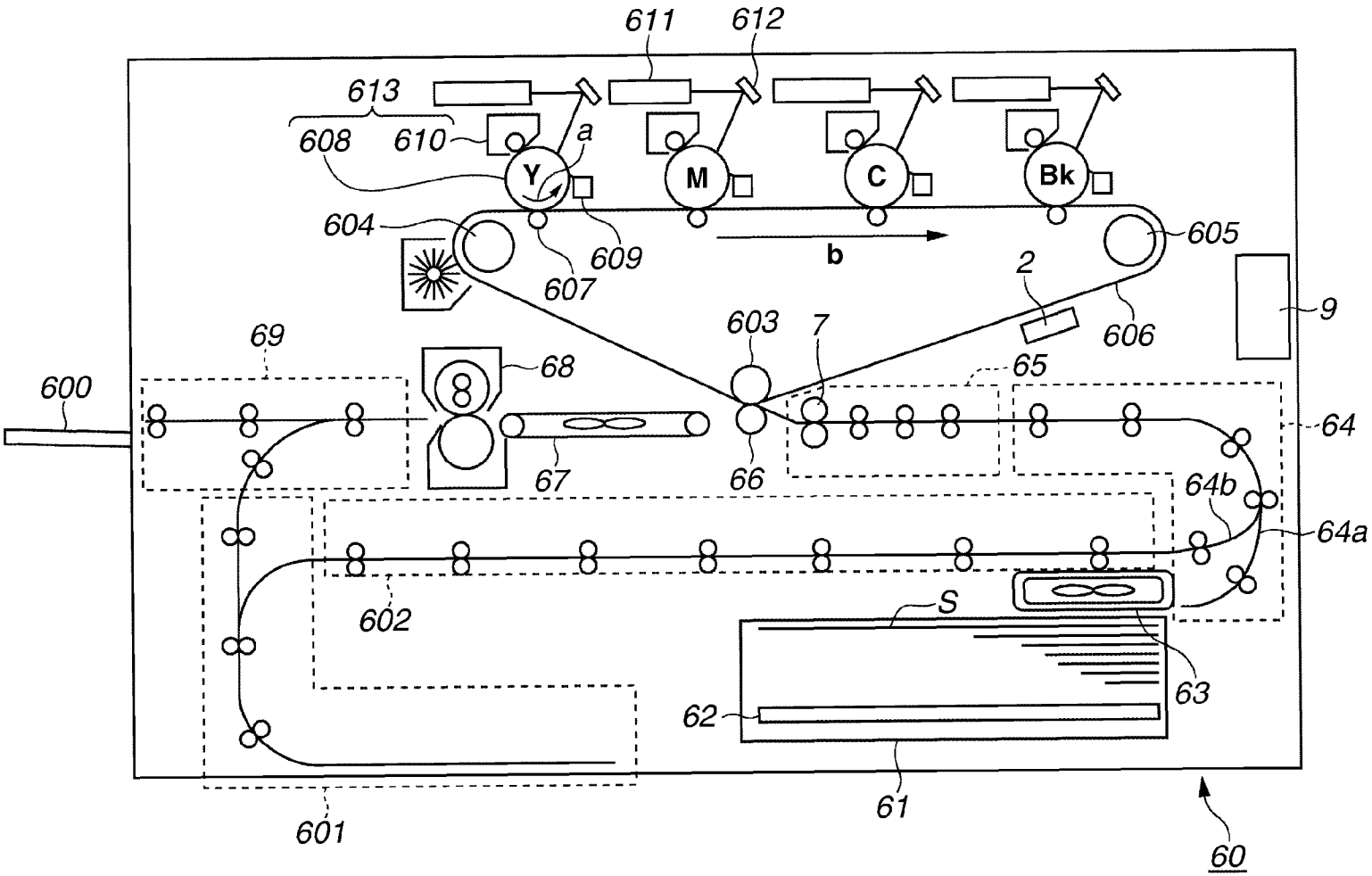
FIG. 1 illustrates a longitudinal cross-sectional view of an image forming apparatus according to a first exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Exemplary embodiments will be described in detail below with reference to the drawings.

The following are exemplary embodiments of the present invention described with reference to the drawings. In the exemplary embodiments of the present invention, in as far as the distance between an upstream skew roller and a reference surface is variable according to the size of sheets, a part or all of components of the exemplary embodiments can be replaced by alternative components.

Therefore, the present invention is applicable to various image forming apparatuses including electrophotographic image forming apparatuses, offset print systems, and inkjet print systems. An example electrophotographic image forming apparatus is a tandem type including a plurality of image forming units disposed straight in a predetermined order or a rotary type including image forming units disposed around a drum. An example electrophotographic image forming method includes primarily transferring an image onto an intermediate transfer member and secondarily transferring the image from the intermediate transfer member to a sheet. Another electrophotographic image forming method includes directly transferring a toner image from a photosensitive member to a sheet.

First Exemplary Embodiment

FIG. 1 is a longitudinal cross-sectional view of an image forming apparatus according to a first exemplary embodiment of the present invention. As illustrated in FIG. 1, an image forming apparatus 60 according to the first exemplary embodiment is a full-color multifunction peripheral including four-color electrophotographic image forming units arrayed along a straight part of an intermediate transfer belt 606. The intermediate transfer type is different from a direct transfer type in that a transfer drum or a transfer belt does not hold a sheet.

In this respect, the image forming apparatus 60 can perform printing on various types of sheets including thick papers and coated papers. The image forming apparatus 60 can realize parallel processing using a plurality of image forming units and can perform collective transfer of full-color images. The characteristics of an intermediate transfer and tandem type enable the image forming apparatus 60 to attain higher productivity. A paper feeding device 61 includes a lift-up member 62 that can lift a plurality of sheets. A paper feeding unit 63 is configured to feed an uppermost sheet S from the paper feeding device 61 to a conveyance unit 64.

For example, the paper feeding unit 63 is configured as a friction type that includes a feeding roller to separate a paper or as an air type that can use a suction force to hold and separate a sheet. The paper feeding unit 63 according to the first exemplary embodiment is an air-type.

The sheet S, fed from the paper feeding unit 63, passes a conveyance path 64*a* provided in the conveyance unit 64 and reaches a skew registration device 65. The skew registration device 65 performs skew correction for the sheet S and timing correction for synchronizing the sheet S with a toner image formed on the intermediate transfer belt 606. Then, the skew registration device 65 conveys the sheet S to a secondary transfer unit.

The secondary transfer unit includes an inner secondary transfer roller 603 and an external secondary transfer roller 66, which are disposed in an opposed relationship to press the intermediate transfer belt 606 from both sides. The secondary transfer unit is configured to transfer a toner image formed on an intermediate transfer member 606 to the sheet S under a pressing force and a transfer field while the sheet S moves together with the intermediate transfer belt 606.

Four image forming units 613 configured to form toner images of yellow (Y), magenta (M), cyan (C), and black (Bk) are disposed along the intermediate transfer belt 606. Four image forming units 613 are similar in arrangement except for the color of toner stored in a developing device 610. The image forming unit 613 of yellow (Y), disposed at the most upstream side, has the following arrangement. The number of toner colors is not limited to four. The order of toner colors is arbitrarily changeable.

The image forming unit 613 includes a photosensitive drum 608 that rotates in the direction indicated by arrow "a" in FIG. 1. Peripheral devices disposed around the photosensitive drum 608 are a charging device (not illustrated), an exposure apparatus 611, the developing device 610, a primary transfer roller 607, and a drum cleaner 609.

The charging device in the exposure apparatus 611 uniformly charges the surface of the photosensitive drum 608. The exposure apparatus 611 generates a laser beam modulated according to image data. A mirror 612 reflects the laser beam toward the photosensitive drum 608. Namely, the exposure apparatus 611 and the mirror 612 realize exposure scanning using a laser beam for forming an electrostatic latent image on the surface of the photosensitive drum 608. Under an electrostatic force, the developing device 610 applies toner particles to the electrostatic latent image formed on the photosensitive drum 608. Thus, a toner image appears on the photosensitive drum 608.

The primary transfer roller 607 and the photosensitive drum 608, pressing the intermediate transfer belt 606 from both sides, constitute a primary transfer unit configured to transfer a toner image formed on the photosensitive drum 608 to the intermediate transfer belt 606 by applying a predetermined pressing force and a transfer field to the toner image. The drum cleaner 609 collects toner particles remaining on the surface of the photosensitive drum 608 after the toner image is transferred to the intermediate transfer belt 606.

Thus, the photosensitive drum 608 can stand by for the next image forming processing.

The intermediate transfer belt 606, which is entrained around a driving roller 604, a tension roller 605, and the inner secondary transfer roller 603, can rotate in the direction indicated by arrow "b", as illustrated in FIG. 1. The Y, M, C, and Bk image forming units 613 perform parallel image forming processes of respective colors at predetermined timing to accurately overlap images with upstream toner images already transferred on the intermediate transfer belt 606. As a result, the intermediate transfer belt 606 conveys a full-color toner image finally formed on the intermediate transfer belt 606 to the secondary transfer unit. As described above, a full-color toner image formed on the intermediate transfer belt 606 is transferred onto the sheet S fed to the secondary transfer unit. Then, a pre-fixing conveyance unit 67 conveys the sheet S to a fixing device 68.

The fixing device 68 includes a pair of opposed rollers or belts that can apply a predetermined pressing force to the sheet S and a heat source (e.g., a heater) that can generate heat to melt and fix a toner image formed on the sheet S. A diverging conveyance device 69 receives the sheet S carrying a fixed image formed thereon and directly discharges the sheet S to a discharge tray 600. When the image forming apparatus 60 performs two-sided image formation, the diverging conveyance device 69 can switch its conveyance path to convey the sheet S toward a reversing conveyance device 601.

After completing a switchback motion in the reversing conveyance device 601, the sheet S enters a two-sided conveyance device 602 with leading and trailing edges switched each other. Then, in synchronism with a conveyance gap between two sheets conveyed by the paper feeding device 61 instructed according to a following job, the conveyance unit 64 causes the sheet S coming from a re-feeding path 64*b* to enter the sheet conveyance path connected to the secondary transfer unit for two-sided image formation. Image forming processing for the reverse surface (second surface) is similar to the above-described processing for the front surface (first surface).

The switchback mechanism for the reversing conveyance device 601 is relatively simple in configuration and does not require a large space for reversing the sheet S. However, the switchback mechanism switches the leading and trailing edges of the sheet S in the process of reversing the sheet S. To ensure positioning of images formed on front and rear surfaces of the sheet S, it is necessary to set a common reference edge that regulates the position in a direction perpendicular to the sheet conveyance direction.

Therefore, the skew registration device 65 has a reference surface extending in a direction parallel to the sheet conveyance direction. The skew registration device 65 performs skew correction on the sheet S by causing one end of the sheet S to move along the reference surface. The skew registration device 65 is capable of accurately adjusting the transfer position of toner images formed on front and reverse surfaces of the sheet S.

In a sheet conveyance apparatus, if any skew or positional deviation of a sheet occurs during conveyance of the sheet, print accuracy may deteriorate when printing is performed on the sheet. Similarly, a conveyance path provided in an image forming apparatus is required to assure positioning accuracy for an image formed on a sheet, in particular, when image formation is performed on front and reverse surfaces of a sheet.

Accordingly, the image forming apparatus 60 includes the skew registration device 65 positioned immediately before (on the upstream side of) the secondary transfer unit that forms an image on a sheet surface. The skew registration device 65 corrects a skew or a positional deviation of a sheet occurring during conveyance of the sheet in a long conveyance path extending from the paper feeding device 61. In other words, the skew registration device 65 assures higher accuracy in positioning an image.

Figure 2:
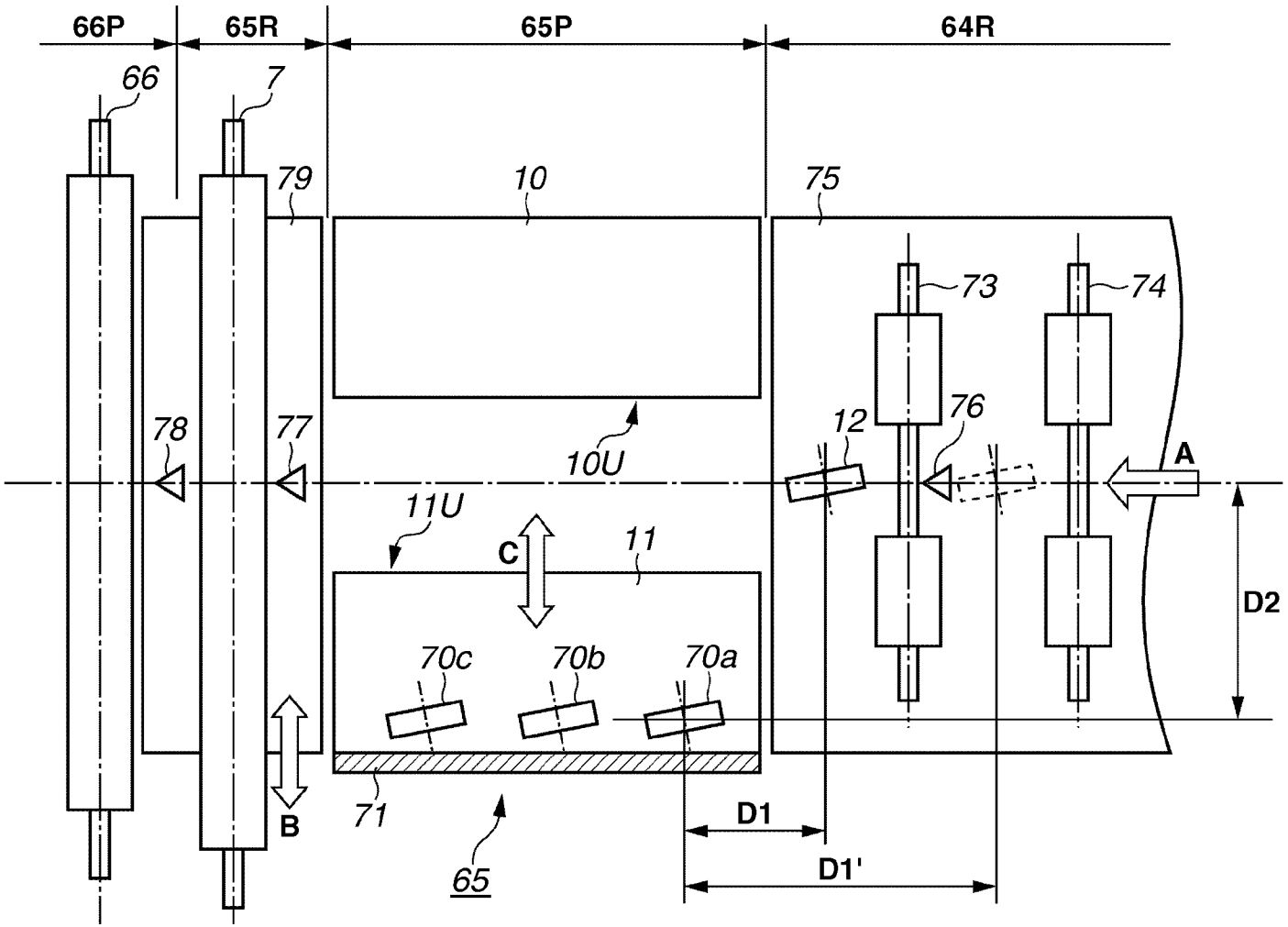
FIG. 2 illustrates a plan view of a conveyance unit including a skew registration device according to the first exemplary embodiment.

The skew registration device 65 obliquely conveys a sheet toward an abutment reference member 71 while speedily conveying the sheet. Therefore, a side of the sheet contacts the abutment reference member 71. Then, the sheet moves straight along the abutment reference member 71 (as illustrated in FIG. 2). In other words, the skew registration device 65 can adjust the orientation of a conveyed sheet to be parallel to the sheet conveyance direction.

The skew registration device 65 contributes to a product excellent in image positioning accuracy. The skew registration device 65 can be applied to a high-end machine as a printing machine. However, such a high-end machine is often required to perform printing on a wide variety of sheets. Therefore, the skew registration device 65 is required to assure stable performances in aligning conveyed sheets, considering various material parameters (sheet size, thickness, grammage, friction coefficient, smoothness, etc.) as well as environmental parameters (temperature, humidity, etc.).

Figure 3:
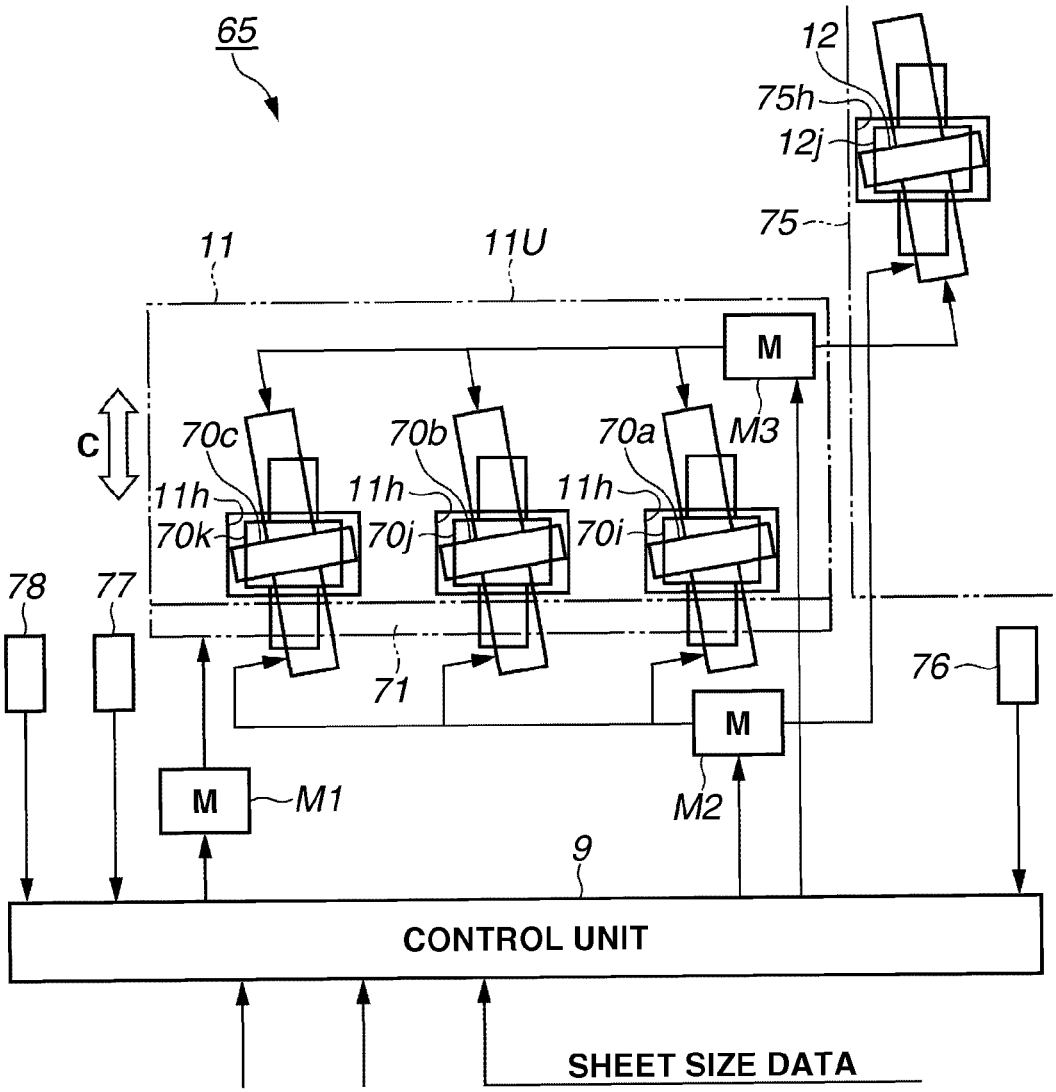
FIG. 3 illustrates a driving mechanism of the skew registration device.
Figure 4:
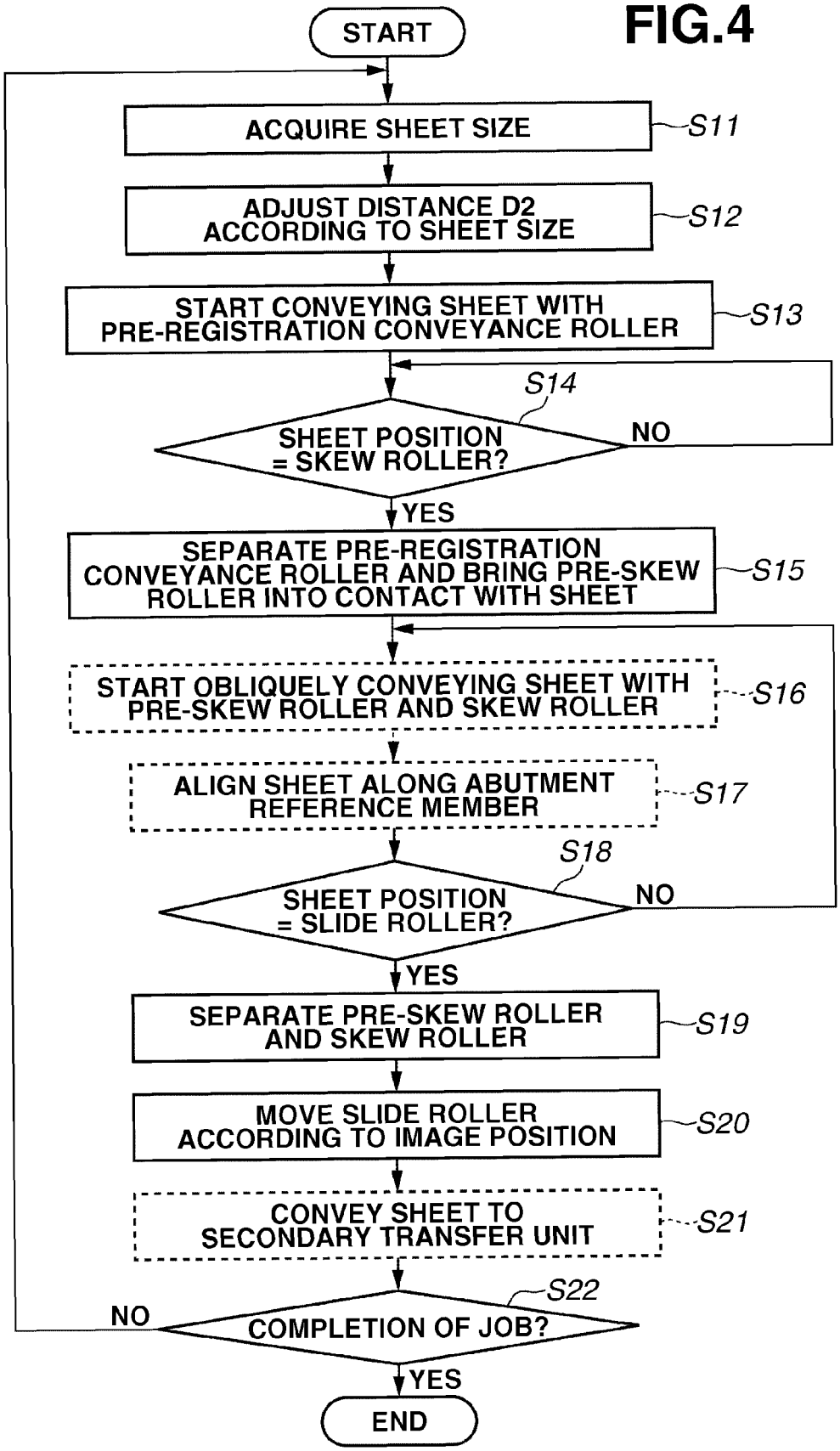
FIG. 4 is a flowchart illustrating an example conveyance control operation.

FIG. 2 illustrates a plan view of the conveyance unit including the skew registration device according to the first exemplary embodiment. FIG. 3 illustrates a driving mechanism for the skew registration device. FIG. 4 is a flowchart illustrating an example conveyance control operation. FIG. 5 illustrates various phases of the conveyance control operation.

As illustrated in FIG. 2, the skew registration device 65 receives a sheet conveyed from a pre-registration conveyance unit 64R (an upstream device) in the sheet conveyance direction indicated by an arrow "A" and sends the received sheet to a secondary transfer unit 66P (a downstream device). The skew registration device 65 includes a skew registration unit 65P configured to perform skew correction and side edge alignment for a received sheet and a slide unit 65R configured to convey a sheet by a predetermined amount in a direction perpendicular to the sheet conveyance direction. Thus, the skew registration device 65 has a function of positioning a sheet in the axial direction of the external secondary transfer roller 66.

The pre-registration conveyance unit 64R includes pre-registration conveyance rollers 73 and 74 that receive a sheet conveyed along the conveyance guide 75 and convey the sheet in the direction indicated by arrow "A." The pre-registration conveyance rollers 73 and 74 can rotate when the rollers 73 and 74 contact driven rollers (not illustrated) via openings formed on the conveyance guide 75 (see FIG. 1). The pre-registration conveyance unit 64R and the skew registration unit 65P constitute a sheet conveyance apparatus that sets a conveyance reference on the center line extending in the sheet conveyance direction.

A pre-skew roller 12, positioned on the center line of the sheet conveyance path, receives a sheet from the pre-registration conveyance roller 73 and obliquely conveys the sheet toward the abutment reference member 71. The distance between a nip portion of a most upstream side skew roller 70*a* and a nip portion of the pre-skew roller 12 in the sheet conveyance direction is set to distance D1, as described below.

The skew registration unit 65P includes a movable guide 11 and a stationary guide 10, which cooperatively receive a sheet conveyed from the pre-registration conveyance unit 64R. The skew registration unit 65P includes three skew rollers 70*a*, 70*b*, and 70*c*, which can obliquely convey a sheet toward the abutment reference member 71 and bring a side of the sheet into line contact with the abutment reference member 71. When the sheet starts sliding along the abutment reference member 71, the sheet has an aligned orientation that coincides with the sheet conveyance direction.

The skew registration unit 65P includes a movable unit 11U and a stationary unit 10U. The movable unit 11U integrates the movable guide 11, three skew rollers 70*a*, 70*b*, and 70*c*, and the abutment reference member 71. The stationary unit 10U includes the stationary guide 10. The position of the movable unit 11U is determined according to the size of sheets received from the pre-registration conveyance rollers 73 and 74.

The pre-skew roller 12 and the skew rollers 70*a*, 70*b*, and 70*c* obliquely convey a received sheet. A side of the obliquely conveyed sheet collides with the abutment reference member 71 (an example reference member).

The slide unit 65R includes a conveyance guide 79, a slide roller 7, a pre-slide sensor 77, and a post-slide sensor 78. The slide roller 7 can slide in the direction indicated by arrow "B" while it rotates to convey a sheet. The slide roller 7 can adjust the thrust position of a sheet, which is skew-corrected by the skew registration unit 65P, according to the image position on the intermediate transfer belt 606.

As illustrated in FIG. 1, the secondary transfer unit 66P includes the external secondary transfer roller 66, the inner secondary transfer roller 603, and the intermediate transfer belt 606. Transfer timing of a toner image on the intermediate transfer belt 606 is adjustable by controlling arrival timing of a leading edge of a sheet based on a detection signal obtained by the post-slide sensor 78.

As illustrated in FIG. 3, the setup position of three skew rollers 70*a*, 70*b*, and 70*c* is sufficiently close to the abutment reference member 71 so as to prevent the sheet from generating any buckling and floating when a sheet is pressed against the abutment reference member 71. If the distance from the sheet nipped by the skew rollers 70*a*, 70*b*, and 70*c* to the abutment reference member 71 is long, the side edge alignment may be incomplete when a sheet thoroughly passes the abutment reference member 71.

The skew rollers 70*a*, 70*b*, and 70*c* (first skew rotary members) are in a fixed positional relationship with the abutment reference member 71. The skew rollers 70*a*, 70*b*, and 70*c* can contact driven rollers 70*i*, 70*j*, and 70*k* via openings 11*h* formed on the movable guide 11. A frictional force generated by the driven rollers 70*i*, 70*j*, and 70*k*, which contact a sheet, is smaller than a frictional force generated by the skew rollers 70*a*, 70*b*, and 70*c*. The altitudinal position where the driven rollers 70*i*, 70*j*, and 70*k* contact the skew rollers 70*a*, 70*b*, and 70*c* is slightly higher than a flat surface of the movable guide 11.

The pre-skew roller 12 (second skew rotary member) is similar to the skew rollers 70*a*, 70*b*, and 70*c* in configuration. The pre-skew roller 12 can contact a driven roller 12*j* via an opening 75*h* formed on the conveyance guide 75. A frictional force generated by the driven roller 12*j*, which contacts a sheet, is smaller than a frictional force generated by the pre-skew roller 12. The altitudinal position where the driven roller 12*j* contacts the pre-skew roller 12 is slightly higher than an upper surface of the conveyance guide 75.

An exemplary embodiment includes appropriate friction coefficients and cross-sectional shapes for the skew rollers 70*a*, 70*b*, and 70*c* and the pre-skew roller 12, which are employed so that a sheet can rotate along the abutment reference member 71 in a state where two or more of the skew rollers 70*a*, 70*b*, and 70*c* and the pre-skew roller 12 obliquely convey the sheet.

A motor M3 rotates the skew rollers 70*a*, 70*b* and 70*c*, the pre-skew roller 12, the pre-registration conveyance rollers 73 and 74 (see FIG. 2), and the slide roller 7 (see FIG. 2). The motor M3 can convey a sheet, via the rollers, at a uniform speed in the direction indicated by arrow "A."

A motor M2, serving as a contact/separation mechanism, elevates the skew rollers 70*a*, 70*b*, and 70*c*, the pre-skew roller 12, and the pre-registration conveyance rollers 73 and 74 (see FIG. 2) to enable the rollers to come into contact with or separate from the driven rollers 70*i*, 70*j*, 70*k*, and 12*j*.

When the skew rollers 70*a*, 70*b*, and 70*c*, and the pre-skew roller 12 move downward to contact a sheet, the pre-registration conveyance rollers 73 and 74 (see FIG. 2) separate from the sheet. A motor M1, serving as a first adjustment unit, drives the movable unit 11U. The movable unit 11U is movable in the direction indicated by arrow "C." In other words, the abutment reference member 71, serving as a reference member, is movable in the sheet width direction. The motor M1 can change the distance between the abutment reference member 71 and the pre-skew roller 12 according to the size of sheets.

A control unit 9 (an example control unit) performs control processing according to the flowchart illustrated in FIG. 4. When a pre-registration conveyance sensor 76 detects the leading edge of a sheet, the control unit 9 stops the sheet at a position corresponding to the pre-registration conveyance roller 73. This is to reset a cumulative error with respect to passing timing of the leading edge, if such an error occurs during the conveyance of a paper.

In step S11, the control unit 9 acquires the size of a sheet. The control unit 9 determines a distance D2 between the nip portion of the skew rollers 70*a*, 70*b*, and 70*c* and the nip portion of the pre-skew roller 12 in the width direction of the sheet. More specifically, the control unit 9 sets the distance D2 to be a half of the width of a conveyed sheet.

In step S12, the control unit 9 controls the motor M1 to cause the movable unit 11U to slide in the direction indicated by arrow "C" (in the width direction of the sheet). Thus, the control unit 9 stops the movable unit 11U to stay at the position where the distance between the skew rollers 70*a*, 70*b*, and 70*c* and the pre-skew roller 12 becomes D2.

In step S13, the control unit 9 controls the motor M3 to cause the pre-registration conveyance rollers 73 and 74 to start conveying a sheet. In step S14, the control unit 9 determines, with reference to, for example, a timer count value, whether the sheet conveyed by the pre-registration conveyance rollers 73 and 74 has reached a position corresponding to the skew roller 70*a*.

If the sheet has reached the skew roller 70*a* (YES in step S14), the processing proceeds to step S15. In step S15, the control unit 9 causes the motor M2 to lift the pre-registration conveyance rollers 73 and 74 to release a nipping force applied to the sheet. If the rollers 73 and 74 continuously nip the sheet, the sheet travels straight even after the skew roller 70*a* starts obliquely conveying the sheet. The skew roller 70*a* cannot smoothly convey the sheet obliquely.

On the other hand, the pre-skew roller 12 moves downward to nip the center of the sheet and starts obliquely conveying the sheet. Subsequently, the skew roller 70*a* nips an edge of the sheet and starts conveying the sheet. When the skew roller 70*a* starts conveying the sheet, a nipping force generated by the pre-skew roller 12 prevents the sheet from rotating.

In step S16, the pre-skew roller 12 and the skew roller 70*a* start obliquely conveying the sheet. Then, the skew rollers 70*b* and 70*c* successively start obliquely conveying the sheet toward the abutment reference member 71. When the sheet collides with the abutment reference member 71, the sheet starts rotating until the orientation of the sheet corresponds to the sheet conveyance direction. Namely, in step S17, the control unit 9 causes the skew registration device 65 to perform skew correction and side edge alignment.

In step S18, the control unit 9 determines whether the sheet has reached a position corresponding to the slide roller 7. If the pre-slide sensor 77 detects the leading edge of the sheet, the control unit 9 determines that the sheet has reached the position corresponding to the slide roller 7 (YES in step S18). In step S19, the control unit 9 causes the motor M2 (an example contact/separation mechanism) to lift the pre-skew roller 12 and the skew rollers 70*a*, 70*b*, and 70*c* to release the nipping force applied to the sheet. If the rollers 12, 70*a*, 70*b*, and 70*c* continuously nip the sheet, the sheet rotates and inclines when the slide roller 7 slides.

In step S20, the control unit 9 causes the slide roller 7 to slide in the direction indicated by arrow "B" to adjust the sheet position according to a toner image of the intermediate transfer belt 606. In step S21, the control unit 9 causes the slide roller 7 to convey the sheet to the secondary transfer unit. In step S22, the control unit 9 determines whether the job is complete. If the control unit 9 determines that the job is incomplete (NO in step S22), the control unit 9 repeats the processing of steps S11 through S22.

Figure 5A:
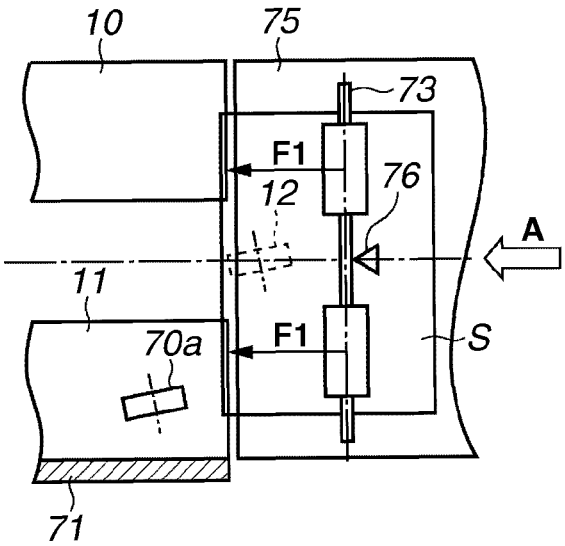
FIGS. 5A to 5C illustrate various phases of the conveyance control operation.
Figure 5B:
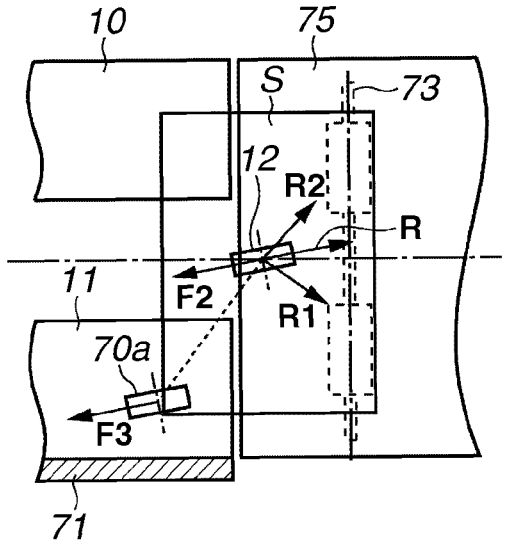
Figure 5C:
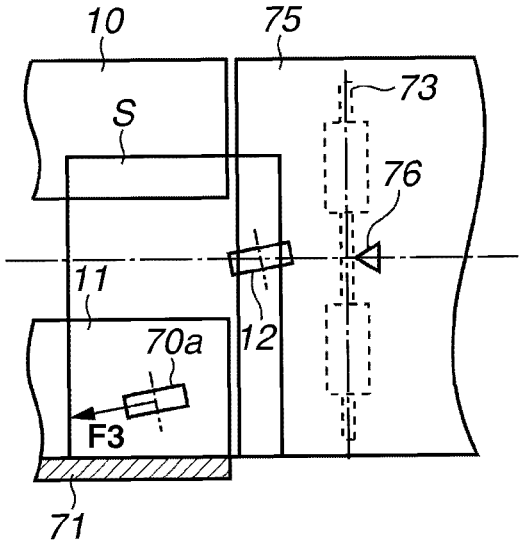

FIGS. 5A to 5C illustrate various phases corresponding to the processing performed in steps S13 to S17 of FIG. 4, in which the sheet length in the conveyance direction is twice as much as the above-described distance D1. FIG. 5A illustrates a state immediately after the pre-registration conveyance roller 73 starts conveying the sheet S after the pre-registration conveyance roller 73 once stops the sheet S. At this moment, the pre-skew roller 12 does not give any nipping force to the sheet S. Only the pre-registration conveyance roller 73 gives a conveyance force F1 to the sheet S. Thus, the sheet S travels in the direction indicated by arrow "A."

FIG. 5B illustrates a state where the leading edge of the sheet S has reached a nip portion of the registration roller 70*a*. At this moment, the pre-registration conveyance rollers 73 and 74 do not give any nipping force to the sheet S. On the other hand, the pre-skew roller 12 gives a nipping force to the sheet S. Thus, two rollers (the skew roller 70*a* and the pre-skew roller 12) convey the sheet S.

The following is the relationship of forces acting on the sheet Sat this moment. The conveyance guide 75 generates a frictional resistance R acting on the sheet S when the skew roller 70*a* gives a conveyance force F3 to the sheet S. The frictional resistance R concentrates on the centroid of the sheet S.

Therefore, if the relationship "sheet length in the sheet conveyance direction=distance D1×2" is satisfied, the pre-skew roller 12 gives a conveyance force F2 to the centroid of the sheet S. The conveyance force F2 cancels the frictional resistance R. As a result, a rotational component R1 decreases. The sheet S approaches the abutment reference member 71 without greatly changing its orientation as illustrated in FIG. 5C. As described above, the example illustrated in FIGS. 5A to 5C satisfies the relationship "sheet length in the sheet conveyance direction=distance D1×2" and can effectively reduce the rotational component R1.

The following is an example that does not satisfy the relationship "sheet length in the sheet conveyance direction=distance D1×2." In this case, the nip portion of the pre-skew roller 12 is offset from the centroid of the sheet S. A significant amount of rotational component R1 is generated regardless of sheet size, because the setup position of the skew roller 70*a* is close to the abutment reference member 71 to prevent the sheet S from buckling when the sheet S collides with the abutment reference member 71.

However, an exemplary embodiment can reduce the rotational component R1 acting on each conveyed sheet by positioning the pre-skew roller 12 on a line passing the centroid of the sheet S and extending in the sheet conveyance direction. More specifically, the control unit 9 moves the movable unit 11U to a position where the distance D2 (FIG. 2) becomes a half of the sheet length in the direction perpendicular to the sheet conveyance direction (i.e., sheet size in the width direction).

To reduce the rotational component R1, it is ideal that the relationship "sheet length in the sheet conveyance direction=distance D1×2" can be satisfied for various types of sheets having different lengths in the sheet conveyance direction. To this end, an exemplary embodiment provides a second adjustment unit configured to move the pre-skew roller 12 and the driven roller 12*j* in the sheet conveyance direction. The second adjustment unit moves the pre-skew roller 12 and the driven roller 12*j* to a position corresponding to a half of the length of the conveyed sheet S in the sheet conveyance direction.

In other words, the second adjustment unit can change the distance D1 between the nip portion of the skew roller 70*a* and the nip portion of the pre-skew roller 12 in the sheet conveyance direction. The pre-skew roller 12 starts conveying the sheet S when the center of the sheet S in the conveyance direction reaches the pre-skew roller 12. As indicated by a dotted line in FIG. 2, the second adjustment unit can move the pre-skew roller 12 to an appropriate position corresponding to one of predetermined distances D1, D1', . . . .

As described above, the first exemplary embodiment can reduce the rotational component R1 acting on the sheet S to enable the sheet S to collide with the abutment reference member 71 at an appropriate (moderate) angle. Therefore, compared to first to third comparative examples described below, the first exemplary embodiment can prevent the leading or trailing edge of the sheet S from colliding at a steep angle with the abutment reference member 71. Thus, the first exemplary embodiment does not damage an abutting edge of the sheet S and eliminates defective abutment caused when an abutting operation is erroneous. The sheet conveyance apparatus and the image forming apparatus according to the first exemplary embodiment can flexibly perform print processing on various print media.

Furthermore, the first exemplary embodiment can stabilize the orientation of a conveyed sheet so that the sheet can smoothly contact the abutment reference member 71. Therefore, compared to the first to third comparative examples, the first exemplary embodiment can locate the skew rollers 70*a*, 70*b*, and 70*c* close to the abutment reference member 71 while setting a required margin for a rotated sheet. Thus, the first exemplary embodiment can reduce the length of the abutment reference member 71 and can downsize the skew registration device 65. Thus, the image forming apparatus according to the first exemplary embodiment can perform printing on a sheet having lower rigidity.

Furthermore, in the first exemplary embodiment, the skew roller 70*a* (first skew rotary member) and the pre-skew roller 12 (second skew rotary member) move to predetermined positions corresponding to an edge and the center of a conveyed sheet in the direction perpendicular to the sheet conveyance direction. Therefore, the first exemplary embodiment can reduce a rotational component acting on a sheet and prevent the sheet from rotating. The setup position of each sensor is not limited to the example illustrated in FIG. 2. The control timing is not limited to the example illustrated in FIG. 4.

An exemplary embodiment includes descriptions (e.g., "centroid" and "half") designating definite positions. However, any description relating to the position does not intend to limit the scope of the present invention. In fact, actual "centroid" and "half" positions tend to deviate from designed positions due to differences in tolerance or conveyance accuracy, and similar effects of the present invention can be assured. Thus, the positional description in an exemplary embodiment does not narrowly limit the present invention.

In the first exemplary embodiment, the pre-skew roller 12 and the skew rollers 70*a*, 70*b* and 70*c* are driving rollers, and the driven rollers 12*j*, 70*i*, 70*j*, and 70*k* are driven rollers. However, the pre-skew roller 12 and the skew rollers 70*a*, 70*b*, and 70*c* can be driven rollers, and the driven rollers 12*j*, 70*i*, 70*j*, and 70*k* also can be driving rollers. Alternatively, all of them can be driving rollers.

In the first exemplary embodiment, the pre-skew roller 12 and the skew rollers 70*a*, 70*b* and 70*c* nip one surface of a sheet and the driven rollers 12*j*, 70*i*, 70*j*, and 70*k* nip the other surface of the sheet. However, the driven rollers 12*j*, 70*i*, 70*j*, and 70*k* are replaceable with a flat surface of a member with a small friction. The pre-skew roller 12 and the skew rollers 70*a*, 70*b*, and 70*c* can be friction rollers capable of rotating the surfaces opposing thereto in an idling state. The above-described modifications are applicable to second and third exemplary embodiments described below.

First Comparative Example

Figure 6:
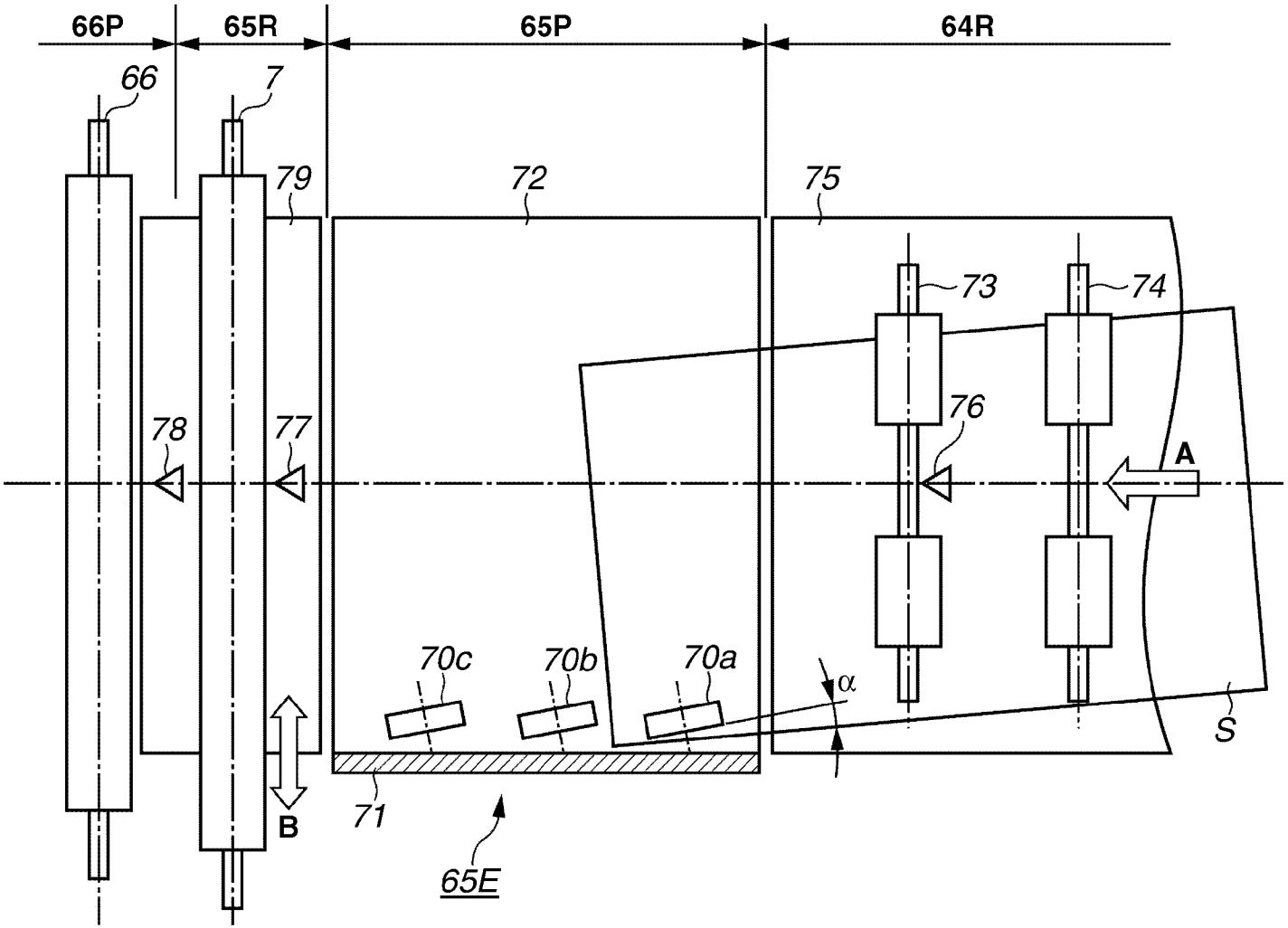
FIG. 6 illustrates a plan view of a skew registration device according to a first comparative example.
Figure 7A:
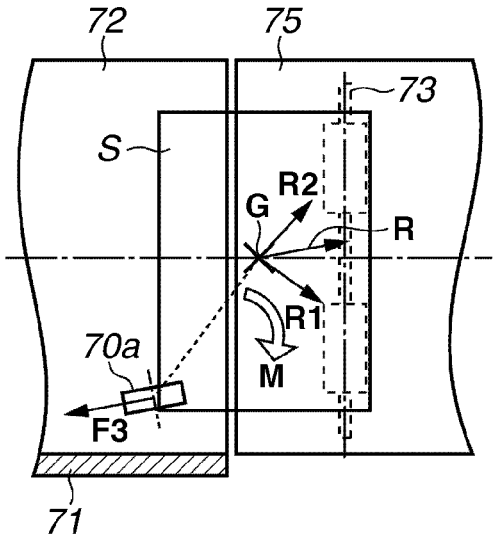
FIGS. 7A and 7B illustrate various phases of a conveyance control operation according to the first comparative example.
Figure 7B:
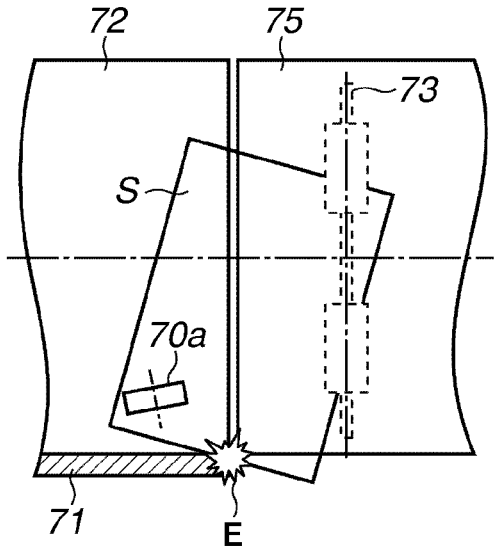

FIG. 6 illustrates a plan view of a skew registration device according to a first comparative example (an example background art). FIGS. 7A and 7B illustrate various phases of a conveyance control operation according to the first comparative example. The first comparative example includes a skew registration device 65E, which is replaceable with the skew registration device 65 illustrated in FIG. 1. The same reference numerals denote similar or common components illustrated in FIGS. 1 and 6.

As illustrated in FIG. 6, the pre-registration conveyance unit 64R receives a sheet placed on the conveyance guide 75. The pre-registration conveyance rollers 73 and 74 convey the sheet in the direction indicated by arrow "A." The pre-registration conveyance unit 64R and the skew registration unit 65P constitute a sheet conveyance apparatus that sets a conveyance reference on the center line extending in the sheet conveyance direction. The skew registration unit 65P includes skew rollers 70*a*, 70*b*, and 70*c* inclined by an angle $\alpha$ relative to the sheet conveyance direction, which can obliquely convey a sheet S placed on a stationary conveyance guide 72 toward the abutment reference member 71.

While the sheet S speedily moves in the conveyance direction, the skew rollers 70*a*, 70*b*, and 70*c* obliquely convey the sheet S toward the abutment reference member 71. When the sheet S collides with the abutment reference member 71, the sheet S starts rotating to change its orientation. Namely, the skew rollers 70*a*, 70*b*, and 70*c* and the abutment reference member 71 cooperatively perform skew correction to align a side of the conveyed sheet S along the abutment reference member 71. At this moment, the pre-registration conveyance rollers 73 and 74 located on the upstream side do not give any nipping force to the sheet S. In other words, the pre-registration conveyance rollers 73 and 74 do not interface with the skew rollers 70*a*, 70*b*, and 70*c* that obliquely convey the sheet S.

As illustrated in FIG. 7A, the sheet S receives a conveyance force F3 from the skew roller 70*a* in a state where the skew roller 70*a* nips the sheet S. The skew roller 70*a* obliquely conveys the sheet S in the direction corresponding to the conveyance force F3. A resistance force R acts on a centroid G of the sheet S due to friction between the conveyance guide 75 and the sheet S. The resistance force R and the conveyance force F3 are mutually opposite.

At this moment, the resistance force R is a sum of a component R1 and a component R2. The component R1 is a rotational component causing the sheet S to rotate around the skew roller 70*a*. The component R2 resists the movement of the sheet S obliquely conveyed. A moment M generated by the rotational component R1 rotates the conveyed sheet S. As a result, an abutting reference edge of the sheet S collides with an inlet edge E of the abutment reference member 71 as illustrated in FIG. 7B.

According to the first comparative example, the moment M constantly appears irrespective of the size of the sheet S in the state illustrated in FIG. 7A. In particular, when the sheet S is an A4-size sheet conveyed with a short side aligned in the conveyance direction, the length of an abutting reference edge becomes shorter than the sheet width. Thereby, the rotational component R1 becomes larger. In addition, when the sheet S is a lightweight sheet, the sheet may be damaged. When the sheet S rotates unnecessarily, the sheet S is damaged and conveyance jam may occur. Accuracy in the sheet skew alignment deteriorates, and the quality of a printing product deteriorates.

Second Comparative Example

Figure 8A:
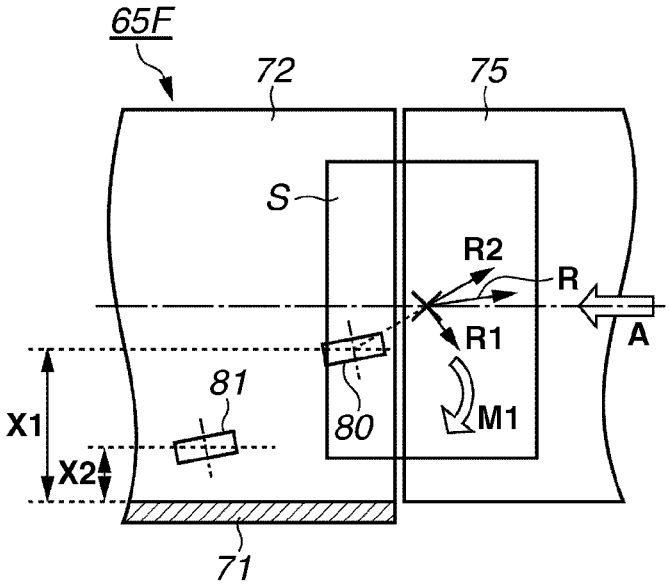
FIGS. 8A to 8C illustrate various phases of a conveyance control operation performed by a skew registration device according to a second comparative example.
Figure 8B:
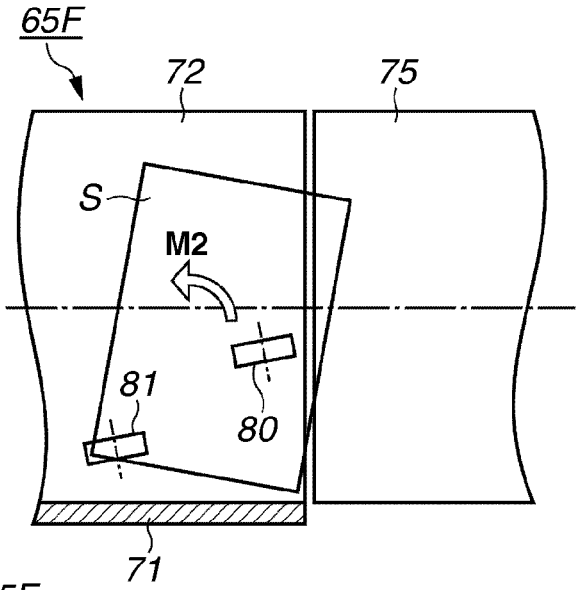
Figure 8C:
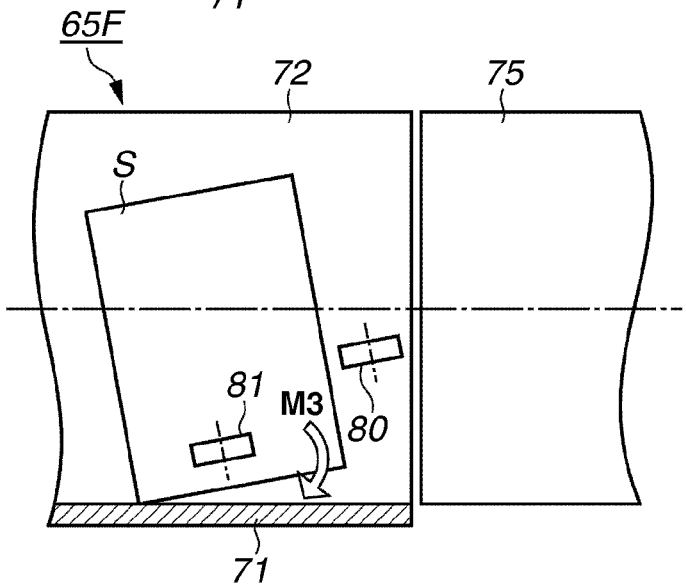

FIGS. 8A to 8C illustrate various phases of a conveyance control operation performed by a skew registration device according to a second comparative example (an example background art). The second comparative example includes a skew registration device 65F, which is replaceable with the skew registration device 65 illustrated in FIG. 1. The same reference numerals common to FIGS. 8A to 8C and FIG. 2 denote similar or common components.

As illustrated in FIG. 8A, the skew registration device 65F includes skew rollers 80 and 81, which are inclined with respect to the conveyance direction. The skew rollers 80 and 81 obliquely convey the sheet S placed on the stationary conveyance guide 72 toward the abutment reference member 71. In the second comparative example, a distance x1 between the abutment reference member 71 and the skew roller 80 is greater than a distance x2 between the abutment reference member 71 and the skew roller 81.

As illustrated in FIG. 8A, when the skew roller 80 nips the sheet S, friction between the sheet S and the conveyance guide 75 generates a resistance force R. A rotational component R1 of the resistance force R generates a moment M1, which causes the sheet S to rotate in the clockwise direction. Thus, the trailing edge of the sheet S moves toward the abutment reference member 71. Then, as illustrated in FIG. 8B, two skew rollers 80 and 81 nip the inclined sheet S. A moment M2 generated at this moment causes the sheet S to rotate in the counterclockwise direction. The sheet S quickly approaches the abutment reference member 71.

As a result, as illustrated in FIG. 8C, the leading edge of the sheet S abuts the abutment reference member 71. A moment M3 generated at this moment causes the sheet S to rotate in the clockwise direction. Then, the orientation of the sheet S is aligned along the abutment reference member 71. The second comparative example satisfies the relationship distance x1>distance x2. The upstream skew roller 80 conveys the sheet S at a position closer to the centroid. Therefore, the rotational component R1 generated in the second comparative example is smaller than the rotational component R1 generated in the first comparative example.

However, if the sheet S is an A4-size sheet conveyed with a short side aligned in the conveyance direction, the sheet S may collide with the abutment reference member 71 as illustrated in FIG. 7B. According to the relationship distance x1>distance x2, the leading edge of the sheet S rotates in a direction departing from the abutment reference member 71 in the state illustrated in FIG. 8A. Therefore, behavior of the sheet S becomes unstable due to alternate changes in the rotational direction after the sheet S reaches the skew roller 80 and until the skew correction is completed.

Third Comparative Example

Figure 9A:
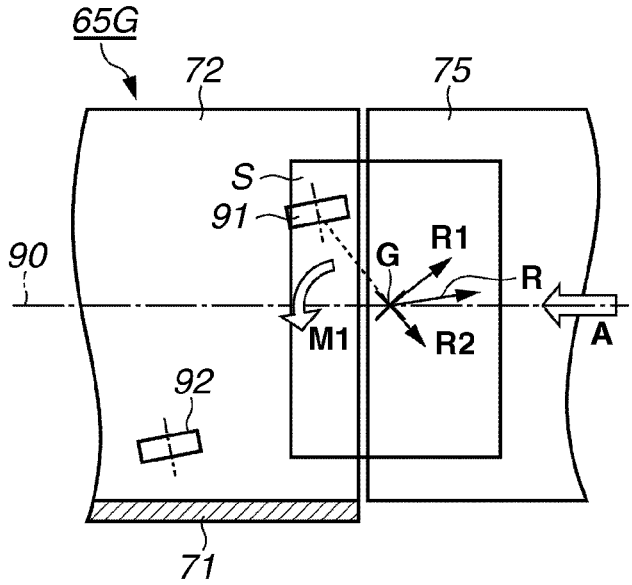
FIGS. 9A to 9C illustrate various phases of a conveyance control operation performed by a skew registration device according to a third comparative example.
Figure 9B:
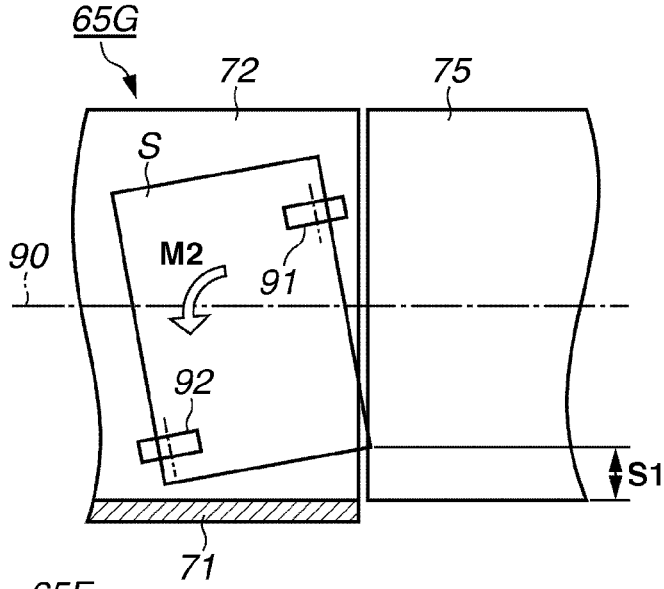
Figure 9C:
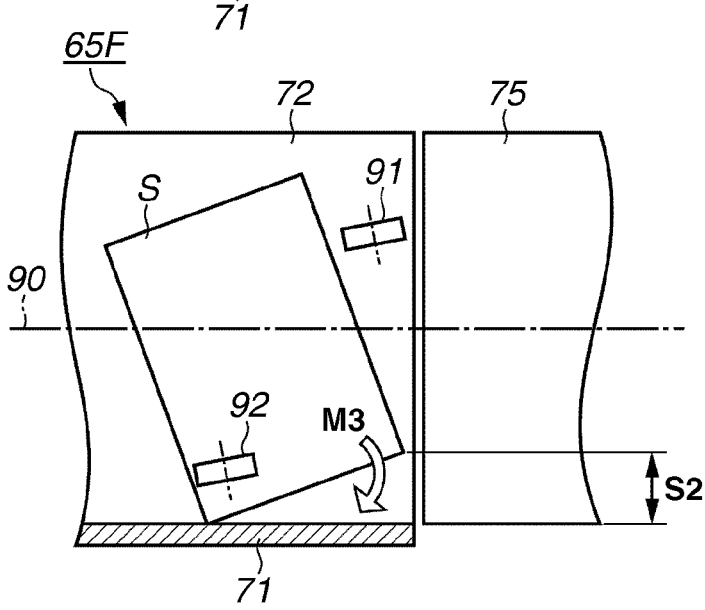

FIGS. 9A to 9C illustrate various phases of a conveyance control operation performed by a skew registration device according to a third comparative example (an example background art). The third comparative example includes askew registration device 65G, which is replaceable with the skew registration device 65 illustrated in FIG. 1. The same reference numerals common to FIGS. 9A to 9C and FIG. 2 denote similar or common components.

As illustrated in FIG. 9A, the skew registration device 65G includes skew rollers 91 and 92, which are inclined with respect to the conveyance direction. The skew rollers 91 and 92 obliquely convey the sheet S placed on the stationary conveyance guide 72 toward the abutment reference member 71. The skew registration device 65G according to the third comparative example constitutes a sheet conveyance apparatus that sets a conveyance reference on the center line extending in the sheet conveyance direction. The skew rollers 91 and 92 are located at both sides of the conveyance center 90 of the sheet S extending in the sheet conveyance direction. The upstream skew roller 91 is farther from the abutment reference member 71 than the conveyance center 90. The downstream skew roller 92 is closer to the abutment reference member 71 than the conveyance center 90.

As illustrated in FIG. 9A, when the upstream skew roller 91 nips the sheet S, a resistance force R acts on the centroid G of the sheet S. A rotational component R1 of the resistance force R generates a moment M1, which causes the sheet S to rotate in the counterclockwise direction. Thus, the leading edge of the sheet S moves toward the abutment reference member 71.

Then, as illustrated in FIG. 9B, two skew rollers 91 and 92 nip the sheet S. At this moment, the rotational component R1 of the resistance force R, which acts on the centroid G of the sheet S, generates a moment M2 to rotate the sheet in the same direction (counterclockwise direction). The moment M2 causes the leading edge of the sheet S to quickly approach the abutment reference member 71.

As a result, the leading edge of the sheet S collides with the abutment reference member 71. At this moment, the sheet is greatly inclined as illustrated in FIG. 9C. A large rotational angle is required to bring the sheet S into a state where a side of the sheet S is aligned along the abutment reference member 71.

In the third comparative example, until the leading edge of the sheet S collides with the abutment reference member 71, the moments M1 and M2 act on the sheet S in the same direction. Therefore, the leading edge of the sheet S smoothly approaches the abutment reference member 71. After the leading edge of the sheet S collides with the abutment reference member 71, the moment M3 acts on the sheet S in the opposite direction. Therefore, the trailing edge of the sheet S can approach the abutment reference member 71.

As a result, compared to the second comparative example, behavior of the sheet S is stable. The sheet S does not collide with the edge of the abutment reference member 71 (see FIG. 7B). However, compared to the second comparative example, the sheet S requires a large rotational angle to reach the abutment reference member 71 at its leading edge. The distance 51 illustrated in FIG. 9B gradually becomes larger toward the distance S2 illustrated in FIG. 9C.

Therefore, in the skew correction (the state illustrated in FIG. 9C), the moment M3 may be insufficient to completely align the sheet S along the abutment reference member 71. Such a problem arises when the friction between the conveyance guide 75 and the sheet S is large, or when the sheet S is a thick paper or any other sheet having a large grammage.

Second Exemplary Embodiment

Figure 10:
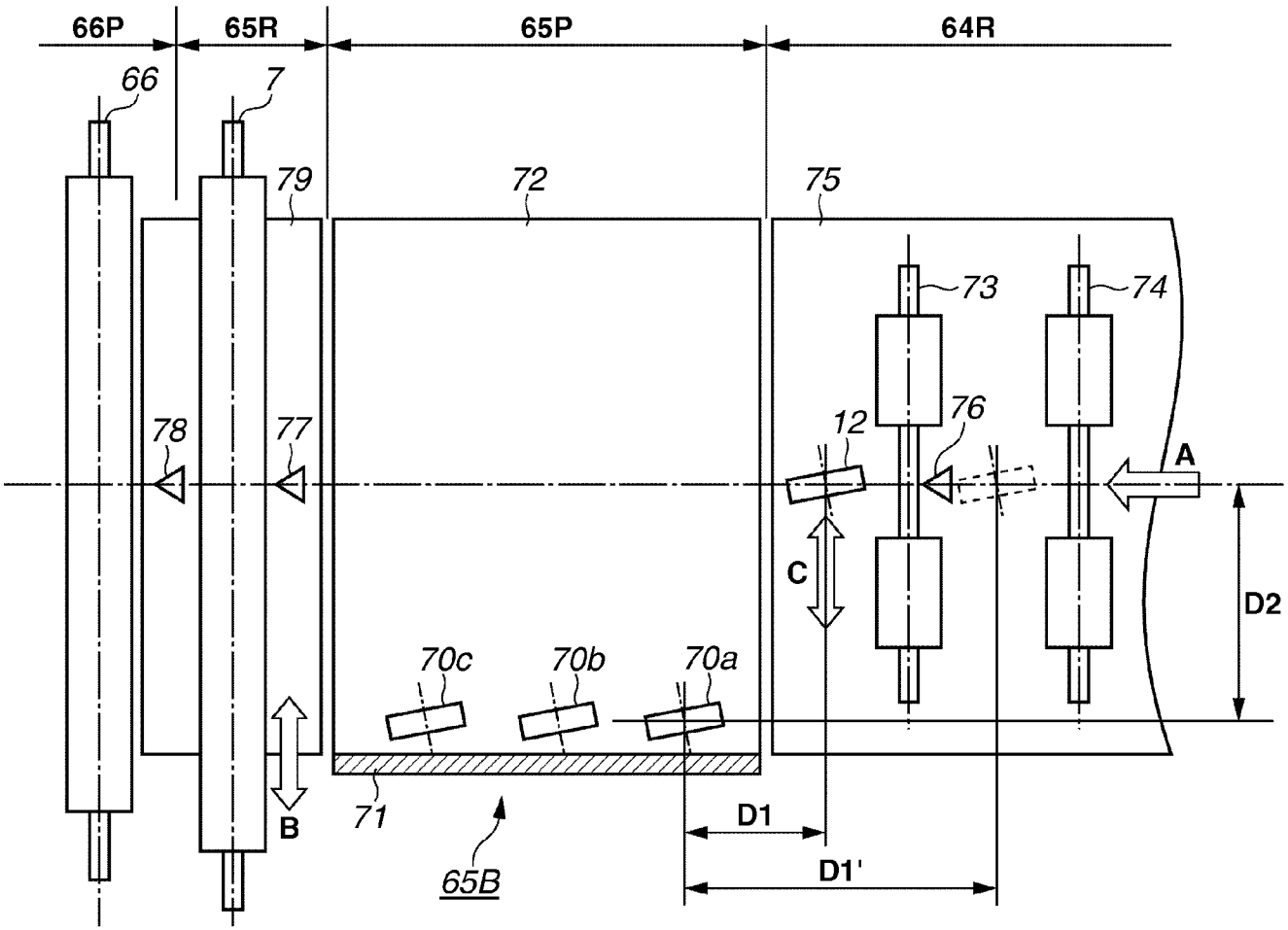
FIG. 10 illustrates a plan view of a skew registration device according to a second exemplary embodiment of the present invention.

FIG. 10 illustrates a plan view of a skew registration device according to a second exemplary embodiment of the present invention. The second exemplary embodiment includes a skew registration device 65B, which is replaceable with the skew registration device 65 illustrated in FIG. 1. The same reference numerals common to FIG. 10 and FIG. 2 denote similar or common components.

As illustrated in FIG. 10, the skew registration device 65B performs skew correction on a sheet received from the pre-registration conveyance rollers 73 and 74 and conveyed in the direction indicated by arrow "A", and sends the skew-corrected sheet to the slide roller 7.

The second exemplary embodiment includes a slide unit 65R and a secondary transfer unit 66P, which are similar to those described in the first exemplary embodiment. The slide roller 7 receives a skew-corrected sheet from the skew registration device 65B and slides in the direction indicated by arrow "B", to adjust the thrust position of the skew-corrected sheet held by the slide roller 7 according to a toner image on the intermediate transfer belt 606 (illustrated in FIG. 1).

In the skew registration device 65B, the skew rollers 70*a*, 70*b*, and 70*c* and the pre-skew roller 12 obliquely convey a sheet placed on the conveyance guide 72 toward the reference member 71 to align a side of the sheet along the reference member 71.

A sheet conveyance apparatus including the skew registration device 65B according to the second exemplary embodiment sets a conveyance reference on one end (the abutment reference member 71) of the apparatus. Therefore, the center-line position of a sheet is variable according to the sheet size in the direction perpendicular to the sheet conveyance direction (sheet width). The conveyance guide 72 used for the skew registration device 65B is a stationary type, which is different from the conveyance guide of the first exemplary embodiment including two separated parts (the stationary guide 10 and the movable guide 11).

In the second exemplary embodiment, the pre-skew roller 12 and the driven roller 12*j* (illustrated in FIG. 3) are integrally movable as a unit in the direction perpendicular to the sheet conveyance direction (the direction indicated by arrow "C") to set a predetermined distance between the pre-skew roller 12 and the conveyance guide 72 according to the size of sheets. The opening 75*h* formed on the conveyance guide 75 illustrated in FIG. 3 has a length comparable to the maximum stroke of the conveyance roller 12 and the driven roller 12*j*.

The control unit 9 (illustrated in FIG. 3) controls a driving mechanism configured to move the integrated unit of the pre-skew roller 12 and the driven roller 12*j* in the direction indicated by arrow "C" to place the pre-skew roller 12 on the center line of a sheet extending in the sheet conveyance direction. More specifically, D2 represents the distance between a nip portion of the skew rollers 70*a*, 70*b*, and 70*c* and a nip portion of the pre-skew roller 12 in the direction perpendicular to the sheet conveyance direction. The control unit 9 equalizes the distance D2 with a half of the width of a conveyed sheet by adjusting the position of the pre-skew roller 12.

The pre-skew roller 12 and the skew rollers 70*a*, 70*b*, and 70*c* perform skew correction on a conveyed sheet according to a method similar to that described in the first exemplary embodiment with reference to FIGS. 4 and 5A to 5C. However, as described above, the conveyance reference is set on one side (the abutment reference member 71). Therefore, the second exemplary embodiment differs from the first exemplary embodiment in that the pre-skew roller 12 moves to a position where the relationship "distance D2=half of sheet width" is satisfied.

Accordingly, in the second exemplary embodiment, FIGS. 5A to 5C illustrate the phases of the conveyance control operation performed after the pre-skew roller 12 has already moved to the predetermined position according to the selected size of a conveyed sheet. The relationship of forces acting on the sheet S and the timing for applying a nipping force by the pre-skew roller 12 are similar to those described in the first exemplary embodiment.

Similar to the first exemplary embodiment, a distance between the nip portion of the skew roller 70*a* and the nip portion of the pre-skew roller 12 in the sheet conveyance direction is equal to the distance D1. More specifically, the second exemplary embodiment can effectively reduce the rotational component R1 by satisfying the relationship "sheet length in the sheet conveyance direction=distance D1×2."

However, even if the above-described relationship is not satisfied, the second exemplary embodiment can effectively reduce the rotational component R1 for a wide variety of sheets having different sheet sizes, because the second exemplary embodiment equalizes the distance D2 with a half of the sheet width and causes the pre-skew roller 12 to start obliquely conveying a sheet at the predetermined position (on a line passing the centroid G of the sheet and extending in the sheet conveyance direction).

To reduce the rotational component R1, it is ideal that the relationship "sheet length in the sheet conveyance direction=distance D1×2" can be satisfied for two or more sheets having different lengths in the sheet conveyance direction. More specifically, an exemplary embodiment provides a second adjustment unit configured to move the pre-skew roller 12 and the driven roller 12*j* in the sheet conveyance direction. The second adjustment unit moves the pre-skew roller 12 and the driven roller 12*j* to a position corresponding to a half of the length of the conveyed sheet S in the sheet conveyance direction.

In other words, the second adjustment unit can change the distance D1 between the nip portion of the skew roller 70*a* and the nip portion of the pre-skew roller 12 in the sheet conveyance direction. The pre-skew roller 12 starts conveying the sheet S when the center of the sheet S in the conveyance direction reaches the pre-skew roller 12. As indicated by a dotted line in FIG. 10, the second adjustment unit can move the pre-skew roller 12 to an appropriate position corresponding to one of predetermined distances D1, D1', . . . .

Although the second exemplary embodiment does not set the conveyance reference to the center, the sheet conveyance apparatus and the image forming apparatus according to the second exemplary embodiment can flexibly perform print processing on various print media. As a modified embodiment, the sheet conveyance apparatus illustrated in FIG. 10 can set the conveyance reference to the other side far from the abutment reference member 71.

Third Exemplary Embodiment

Figure 11:
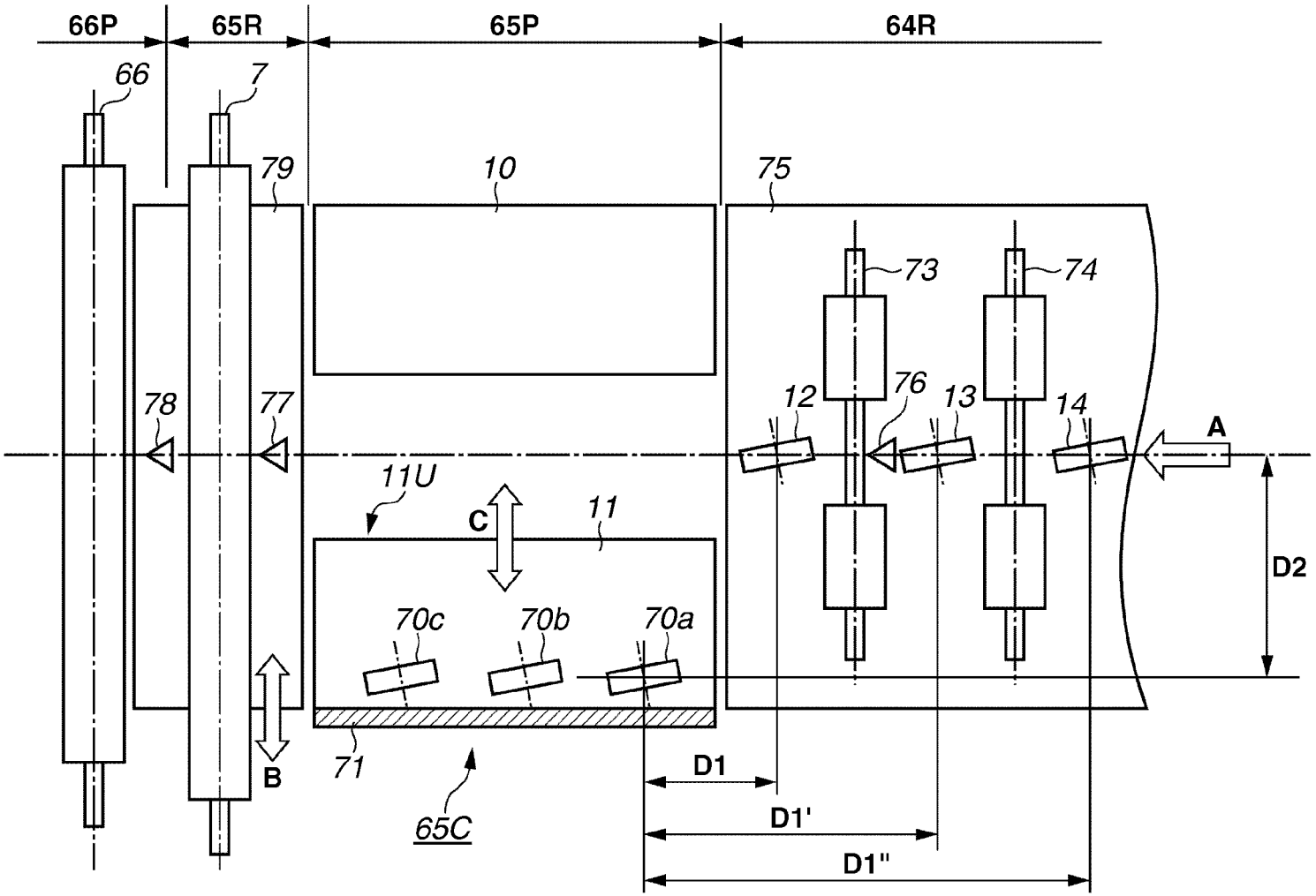
FIG. 11 illustrates a plan view of a skew registration device according to a third exemplary embodiment of the present invention.

FIG. 11 illustrates a plan view of a skew registration device according to a third exemplary embodiment of the present invention. The third exemplary embodiment includes a skew registration device 65C, which is replaceable with the skew registration device 65 illustrated in FIG. 1. The same reference numerals common to FIG. 11 and FIG. 2 denote similar or common components.

As illustrated in FIG. 11, the skew registration device 65C performs skew correction on a sheet received from the pre-registration conveyance rollers 73 and 74 and conveyed in the direction indicated by arrow "A", and sends the skew-corrected sheet to the slide roller 7.

The third exemplary embodiment includes a slide unit 65R and a secondary transfer unit 66P, which are similar to those described in the first exemplary embodiment. The slide roller 7 receives a skew-corrected sheet from the skew registration device 65C and slides in the direction indicated by arrow "B", to adjust the thrust position of the skew-corrected sheet held by the slide roller 7 according to a toner image on the intermediate transfer belt 606 (illustrated in FIG. 1).

The pre-registration conveyance unit 64R and the skew registration unit 65P according to the third exemplary embodiment constitute a sheet conveyance apparatus that sets a conveyance reference on the center line extending in the sheet conveyance direction. The skew registration device 65C according to the third exemplary embodiment is similar to the skew registration device 65 described in the first exemplary embodiment. The skew registration device 65C obliquely conveys a sheet placed on the movable guide 11 of the movable unit 11U and the stationary guide 10 toward the reference member 71 to align a side of the sheet along the reference member 71.

The movable unit 11U can move in the direction indicated by arrow "C" to a predetermined position determined according to the size of a conveyed sheet. More specifically, D2 represents the distance between a nip portion of the skew rollers 70*a*, 70*b*, and 70*c* and a nip portion of the pre-skew roller 12 in the direction perpendicular to the sheet conveyance direction. The control unit 9 (FIG. 3) sets the position of the movable unit 11U to equalize the distance D2 with a half of the width of a conveyed sheet.

In the third exemplary embodiment, three pre-skew rollers 12, 13, and 14 are positioned on the center line (conveyance reference) of the pre-registration conveyance unit 64R. Each of the three pre-skew rollers 12, 13, and 14 is independently elevatable. D1, D1', and D1" represents distances from the nip portions of respective pre-skew rollers 12, 13, and 14 to the nip portion of the skew roller 70*a* in the sheet conveyance direction. Therefore, the pre-skew rollers 12, 13, and 14 can contact a sheet at different positions in the sheet conveyance direction.

For example, the distances D1, D1', and D1" are equal to half-lengths of A4, A4R, and A3 sheets, respectively, in the sheet conveyance direction. The control unit 9 can select an appropriate one of the pre-skew rollers 12, 13, and 14 according to the centroid position of a conveyed sheet. More specifically, each of the pre-skew rollers 12, 13, and 14 (second adjustment unit) includes a nip releasing mechanism. The control unit 9 selects an optimum pre-skew roller according to the size of a conveyed sheet so that the selected pre-skew roller can nip a portion closest the centroid of the sheet.

The pre-skew rollers 12, 13, and 14 and the skew rollers 70*a*, 70*b*, and 70*c* perform skew correction on a sheet according to a method similar to that described with reference to FIGS. 4 and 5A to 5C in the first exemplary embodiment. However, as described above, the third exemplary embodiment differs from the second exemplary embodiment in that the control unit 9 selects an optimum one from among a plurality of pre-skew rollers 12, 13, and 14. Therefore, the third exemplary embodiment replaces the pre-skew roller 12 described in the first exemplary embodiment with the pre-skew roller 13 or the pre-skew roller 14 according to the size of a sheet. However, the relationship of forces acting on the sheet S and the timing for applying a nipping force by the selected pre-skew roller (12, 13, or 14) are similar to those described in the first exemplary embodiment.

The third exemplary embodiment can greatly reduce the rotational component R1 regardless of the size of a conveyed sheet, and enables the sheet to approach the abutment reference member 71 smoothly. The number of pre-skew rollers illustrated in FIG. 11 is not limited to three and can be four or above suitable for the sizes of sheets.

If the number of installable pre-skew rollers is limited, it is desirable to locate the pre-skew rollers at positions corresponding to the sizes of frequently used sheets. In this case, if a conveyed sheet has a non-defined size, the control unit 9 selects an optimum pre-skew roller positioned closest to the centroid of the sheet to reduce the rotational component R1.

The arrangement of a plurality of pre-skew rollers, employed for the sheet conveyance apparatus illustrated in FIG. 11, is applicable to a sheet conveyance apparatus that sets a conveyance reference on one side as described in the second exemplary embodiment. In this case, as described in the second exemplary embodiment, the sheet conveyance apparatus includes a mechanism for moving a plurality of pre-skew rollers in the direction perpendicular to the sheet conveyance direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet conveyance apparatus comprising:

a rotary convey member configured to convey a sheet;

a reference member disposed in a sheet conveyance direction so as to align a side of a sheet along the reference member;

a first skew rotary member configured to obliquely convey the sheet conveyed by the rotary convey member toward the reference member;

a second skew rotary member, which is positioned between the rotary convey member and the first skew rotary member in a sheet conveyance direction and farther from the reference member than the first skew rotary member configured to obliquely convey the sheet toward the reference member;

a contact/separation mechanism configured to bring the second skew rotary member into contact with the sheet conveyed by the rotary convey member or separate the second skew rotary member from the sheet; and a control unit configured to determine whether the sheet conveyed by the rotary convey member reached a position corresponding to the first skew rotary member and configured to control the contact/separation mechanism to cause the second skew rotary member to separate from the sheet conveyed by the rotary convey member and to cause the second skew rotary member to contact the sheet at a timing when the sheet conveyed by the rotary convey member reaches the first skew rotary member, wherein after the sheet conveyed by the rotary convey member reaches the first skew rotary member, the sheet is conveyed by both the first skew rotary member and the second skew rotary member toward the reference member to reduce a rotational component acting on the sheet.

2. The sheet conveyance apparatus according to claim 1, wherein the second skew rotary member is positioned at a central position of the sheet conveyed by the rotary convey member in a direction perpendicular to the sheet conveyance direction.

3. The sheet conveyance apparatus according to claim 1, wherein the second skew rotary member is substantially positioned corresponding to a centroid of the sheet when the sheet conveyed by the rotary convey member is reached to the first skew rotary member.

4. An image forming apparatus comprising:

a rotary convey member configured to convey a sheet;

a reference member disposed in a sheet conveyance direction so as to align a side of a sheet along the reference member;

a first skew rotary member configured to obliquely convey the sheet conveyed by the rotary convey member toward the reference member;

a second skew rotary member, which is positioned between the rotary convey member and the first skew rotary member in a sheet conveyance direction and farther from the reference member than the first skew rotary member, configured to obliquely convey the sheet toward the reference member;

a contact/separation mechanism configured to bring the second skew rotary member into contact with the sheet conveyed by the rotary convey member or separate the second skew rotary member from the sheet; and an image forming unit configured to form an image on the sheet aligned by the reference member; and a control unit configured to determine whether the sheet conveyed by the rotary convey member reached a position corresponding to the first skew rotary member and configured to control the contact/separation mechanism to cause the second skew rotary member to separate from the sheet conveyed by the rotary convey member and to cause the second skew rotary member to contact the sheet at a timing when the sheet conveyed by the rotary convey member reaches the first skew rotary member, wherein after the sheet conveyed by the rotary convey member reaches the first skew rotary member, the sheet is conveyed by both the first skew rotary member and the second skew rotary member toward the reference member to reduce a rotational component acting on the sheet.

5. The image forming apparatus according to claim 4, wherein the second skew rotary member is positioned at a central position of the sheet conveyed by the rotary convey member in a direction perpendicular to the sheet conveyance direction.

6. The image forming apparatus according to claim 4, wherein the second skew rotary member is substantially positioned corresponding to a centroid of the sheet when the sheet conveyed by the rotary convey member is reached to the first skew rotary member.

* * * * *